US005659342A

United States Patent [19]

Lund et al.

[11] Patent Number: 5,659,342

[45] Date of Patent: Aug. 19, 1997

[54] ON-PAGE INKJET PRINTHEAD SPITTING SYSTEM

[75] Inventors: Mark D. Lund, Vancouver; Jefferson P. Ward, Brush Prairie, both of Wash.

[73] Assignee: Hewlett-Packard Company, Palo Alto, Calif.

[21] Appl. No.: 316,150

[22] Filed: Sep. 30, 1994

[51] Int. Cl.[6] ..... B41J 2/165

[52] U.S. Cl. ..... 347/35; 347/24

[58] Field of Search ..... 347/2, 5, 14, 17, 347/22, 23, 30, 35, 60, 9

[56] References Cited

U.S. PATENT DOCUMENTS

| | | | |
|---|---|---|---|
| 4,791,435 | 12/1988 | Smith et al. | 347/35 |
| 5,177,505 | 1/1993 | Sugiura et al. | 347/22 |
| 5,369,428 | 11/1994 | Maze et al. | 347/5 |

FOREIGN PATENT DOCUMENTS

| | | | |
|---|---|---|---|
| A-0316198 | 11/1988 | European Pat. Off. . | |
| A-0443832 | 2/1991 | European Pat. Off. . | |
| A-0451827 | 4/1991 | European Pat. Off. . | |
| 1-174459 | 7/1989 | Japan | 347/9 |
| 2-3324 | 1/1990 | Japan | 347/23 |
| 5-338134 | 12/1993 | Japan | 347/23 |
| 6-15815 | 1/1994 | Japan | 347/35 |

*Primary Examiner*—John E. Barlow, Jr.
*Attorney, Agent, or Firm*—Flory L. Martin

[57] ABSTRACT

An on-page inkjet printhead spitting system purges the printhead nozzles across the printed page, and occasionally in the conventional service station spittoon. In addition to the image-forming droplets, extra purging droplets are fired to maintain pen health. To determine when to purge each nozzle, the number of times each nozzle is fired to print the image is counted or estimated, or printhead characteristics are monitored. The purging dots may be located on the page, in the spittoon, or both. On the page, the purging dots may be hidden from view, in the image background or over the image dots, or hidden in plain sight adjacent image dots, in speed bars, in a watermark type design, or in a repeating pattern. Use of this on-page spitting system conserves ink and improves throughput of the printing mechanism, without requiring any sacrifice in the print quality appearance to the naked eye.

37 Claims, 1 Drawing Sheet

ON-PAGE INKJET PRINTHEAD SPITTING SYSTEM

FIELD OF THE INVENTION

This invention relates generally to an inkjet printing mechanism, and more particularly to a method of periodically purging the inkjet printhead which enhances the mechanism throughput, e.g. pages per minute output, while maintaining a high print quality.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead moves back and forth across the page shooting drops as it moves. Typically, a service station is mounted within the printer chassis to clean and protect the printhead. For storage, or during non-printing periods, the service stations usually include a capping system which humidically seals the printhead nozzles from contaminants and drying. Some caps are also designed to facilitate priming, such as by being connected to a pumping unit that draws a vacuum on the printhead.

During operation, clogs in the printhead are periodically cleared by firing a number of drops of ink through each of the nozzles in a process known as "spitting." In the past, the waste ink was collected in a reservoir portion of the service station, which is often referred to as a "spittoon." After spitting, uncapping, or occasionally during printing, most service stations have an elastomeric wiper that wipes the printhead surface to remove ink residue, as well as any paper dust or other debris that have collected on the printhead.

To improve the clarity and contrast of the printed image, recent research has focused on improving the ink itself. To provide faster, more waterfast printing with darker blacks and more vivid colors, pigment based inks have been developed. These pigment based inks have a higher solid content than the earlier dye based inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves.

Partially or completely blocked nozzles can lead to either missing or misdirected drops on the print media, either of which degrades the print quality. Thus, spitting to clear the nozzles becomes even more important when using pigment based inks, because the higher solids content contributes to the clogging problem more than the earlier dye based inks. Unfortunately, while spittoons were suitable for the earlier dye based inks, they suffer a variety of drawbacks when used with newly developed pigment based inks.

For example, during spitting the inkjet pens are positioned over the spittoon, which consumes valuable printing time, not only to spit, but to position the printheads over the spittoon, and then return the printheads to the page for printing. This time consumption decreases the throughput of the printing mechanism, which is a rated characteristic, often measured in pages per minute. Consumers desire faster printing mechanisms, and those with a lower throughput rating are considered less desirable. As a design compromise, to minimize the loss of page throughput, less time could be devoted to spitting. Unfortunately, this compromise often results in poor quality printed images, from the omission of dots being printed due to clogged nozzles. Thus, in the past there has been an unsatisfactory trade-off between throughput and print quality.

Thus, a need exists for an improved inkjet printhead servicing system, which is directed toward overcoming, and not susceptible to, the above limitations and disadvantages.

SUMMARY OF THE INVENTION

According to one aspect of the invention, a method is provided of purging an inkjet printhead used in an inkjet printing mechanism. The method includes the step of firing selected nozzles of the printhead to deposit image ink droplets on a print media page to print a selected image. In a purging step, selected nozzles are purged by firing to deposit purging ink droplets on the page. In the illustrated embodiments, black ink purging dots are scattered randomly over the page, or in the background areas. For color ink spitting, preferably the nozzles are fired over black print areas, toward the interior to maintain the crisp outline of the black image.

According to another aspect of the present invention, an inkjet printing mechanism is provided, including a chassis and a printhead mounted to the chassis for reciprocal movement across a print zone. The printhead has plural nozzles that are selectively fired to deposit image ink droplets on a print media page to print a selected image in response to a control signal. A controller generates the control signal and monitors the number of image droplets fired from each nozzle. In response to the monitored number of image ink droplets fired, the controller adjusts the control signal to fire purging ink droplets from selected nozzles to deposit purging ink droplets on the page.

An overall goal of the present invention is to provide an inkjet printing mechanism which uses less down-time for servicing to increase throughput, while providing a high quality hardcopy output.

A further goal of the present invention is to provide a method of purging an inkjet pen mounted in a printing mechanism without using the conventional spittoon.

DETAILED DESCRIPTION OF THE PREFERRED EMBODIMENTS

Figure 1:
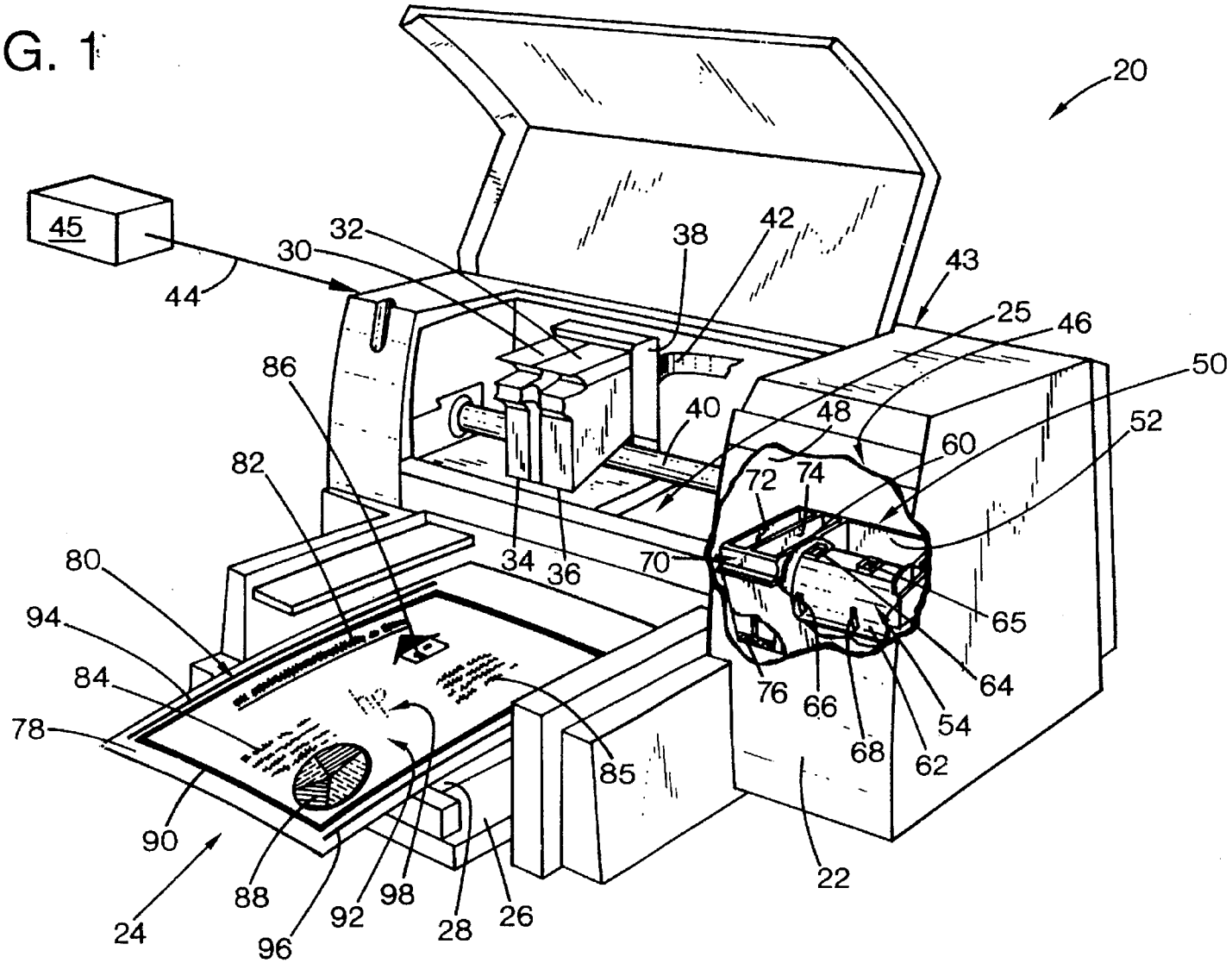
FIG. 1 is a partially schematic, perspective view of one form of an inkjet printing mechanism in operation, here shown as an inkjet printer, using one form of an on-page spitting system of the present invention to generate a hard copy output.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 and a print medium handling system 24 for supplying sheets of print media to the printer 20. The print media may be any type of suitable sheet material, such as paper, card-stock, transparencies, mylar, foils, and the like, but for convenience, the illustrated embodiment is described using paper as the print medium. The print medium handling system 24 moves the print media into a print zone 25 from a feed tray 26 to an output tray 28, for instance using a series of conventional motor-driven rollers (not shown).

In the print zone 25, the media sheets receive ink from an inkjet cartridge, such as a black ink cartridge 30 and/or a color ink cartridge 32. The cartridges 30, 32 are also referred to as "pens" by those in the art. The illustrated color pen 32 is a tri-color pen, although in some embodiments, a group of discrete monochrome pens may be used, or a single monochrome black pen 30 may be used. While the color pen 32 may contain a pigment based ink, for the purposes of illustration, pen 32 is described as containing three dye based ink colors, such as cyan, yellow and magenta. The black ink pen 30 is illustrated herein as containing a pigment based ink. It is apparent that other types of inks may also be used in pens 30, 32, such as paraffin based inks, as well as hybrid or composite inks having both dye and pigment characteristics.

The illustrated cartridges or pens 30, 32 each include reservoirs for storing a supply of ink therein, although other ink supply storage arrangements, such as those having reservoirs (not shown) mounted along the chassis may also be used. The cartridges 30, 32 have printheads 34, 36 respectively. Each printhead 34, 36 has bottom surface comprising an orifice plate with a plurality of nozzles formed therethrough in a manner well known to those skilled in the art. The illustrated printheads 34, 36 are thermal inkjet printheads, although other types of printheads may be used, such as piezoelectric printheads. The printheads 34, 36 typically include a plurality of resistors which are associated with the nozzles. Upon energizing a selected resistor, a bubble of gas is formed ejecting a droplet of ink from the nozzle and onto a sheet of paper in the print zone 25 under the nozzle.

The cartridges or pens 30, 32 are transported by a carriage 38 which may be driven along a guide rod 40 by a conventional drive belt/pulley and motor arrangement (not shown). The pens 30, 32 selectively deposit one or more ink droplets on the print media page in accordance with instructions received via a conductor strip 42 from a printer controller, such as a microprocessor which may be located within chassis 22 at the area indicated generally by arrow 43. The controller may receive an instruction signal carded via conductor 44 from a host device, which is typically a computer, such as a personal computer 45, illustrated schematically FIG. 1. The printhead carriage motor and the paper handling system drive motor operate in response to the printer controller 43, which operates in a manner well known to those skilled in the art. The printer controller may also operate in response to user inputs provided through a key pad, which may be located on the exterior of the chassis in the region generally indicated by arrow 46. A monitor coupled to the computer 45 may be used to display visual information to an operator, such as the printer status or a particular program being run on the computer 45. Personal computers, their input devices, such as a keyboard and/or a mouse device, and monitors are all well known to those skilled in the art.

Located at one end of the travel path of carriage 38, the printer chassis 22 defines a chamber 48 that is configured to receive a service station 50. Preferably, the service station 50 is constructed as a modular device capable of being unitarily inserted into the printer 20, to enhance ease of initial assembly, as well as maintenance and repair in the field. The illustrated service station 50 has a frame 52 that may be slidably received within the chassis chamber 48. However, it is apparent that the service station 50 may also be constructed with the station frame 52 integrally formed within the chassis 22.

The service station 50 has a tumbler portion 54 mounted to frame 52 for rotation when driven by a motor through an optional gear or belt assembly (not shown) that engages a drive gear 60. The tumbler 54 includes a main body 62 which may support a black ink cap 64 and a color ink cap 65. The main body 62 may also support black and color ink wipers 66 and 68 for wiping the respective black and color printheads 34, 36. The wipers 66, 68 may be of an elastomeric material, for instance a nitrile rubber, ethylene polypropylene diene monomer (EPDM) elastomer, or other types of rubber-like materials known to those skilled in the art. The wiping action is usually achieved by moving the printheads 34, 36 across the wipers 66, 68. Other functions may also be provided on the main body 62, such as primers and the like, which are known to those skilled in the art.

The service station 50 may also include an ink collecting chamber or "spittoon" portion 70, which may comprise one or more spittoon chambers. In the illustrated embodiment, the spittoon portion 70 has black and color spittoon chambers 72, 74 to receive ink that is selectively ejected or "spit" from the respective black and color pens 30, 32 when they are positioned above spittoon 70. An absorbent liner material, known as a "diaper" 76, may be placed near the bottom of the spittoon 70 to retain the spit ink while it is drying. Typical liquid absorbent materials may be of a felt, pressboard, sponge, or other comparable materials known to those skilled in the art. Indeed, the diaper 76 may extend under the other components of the service station 50, to absorb any ink leakage, and to provide a larger capillary path for liquids from the spittoon 70 to travel before evaporating. The spittoon 70 may be separated from drive gear 60 by a wall member 78, which may also serve as a side wall for the color spittoon chamber 74.

It is apparent that other arrangements may be used to index the pen capping, wiping, etc. functions rather than the tumbler main body 62. For example gears or linkages (not shown) known to those skilled in the art may be used for selectively engaging the service station equipment 64, 65 and 66, 68 with the respective printheads 34, 36. For instance, suitable translating or floating sled types of service station operating mechanisms are shown in U.S. Pat. Nos. 4,853,717 and 5,155,497, both assigned to the present assignee, Hewlett-Packard Company.

The illustrated printer 20 produces a hard copy output, shown in FIG. 1 as a print media page 78, upon which has been printed an image 80. While it is apparent that the image 80 may take a variety of forms, including text, graphics, photographic images, or other designs, for the purposes of illustration image 80 has several of these components. First, image 80 includes a title portion 82, textual portions 84, 85, a photographic image 86, and a graphic chart, here illustrated as a multi-colored pie chart 88. Preferably, the color pen 32 includes the colors cyan, yellow and magenta ("CYM") which may be combined to provide a full gamut of colors on image 80, such as the pie chart 88 which has varying cross hatching shown to represent the colors purple, blue, gray, and green in FIG. 1. The image 80 also includes a border 90 which extends around the periphery of the page 78. As with most hard copy outputs, the image 80 also includes some blank regions, such as at 92, where no text, title, graphs, border, or other images have been printed.

Rather than always returning the pens 30, 32 to the spittoons 72, 74 for spitting, the illustrated embodiments of the on-page spitting system, implemented in accordance with the present invention, may take several forms. In one illustrated embodiment, the black pen 30 is used, whereas in the another embodiment, the color pen 32 is used. Several methods may be used with both black and color pens. These illustrated methods concern two factors, first, determining when purging is required, and, second, selecting where purging will take place.

Methods for Determining When to Purge Nozzles

These when and where decisions may be made by the firmware, software, hardware alone or in combination (referred to collectively herein as the "control system" or the controller 46) of either the cartridge 30, 32, the printer 20, or both. Alternatively, the host device, such as the computer 45, may determine when spitting is needed, and select the nozzle spitting firing scheme to determine where spitting will occur. Thus, either the controller 46, the host computer 45, or a combination of the two generates a control signal that is delivered to printheads 34, 36 via the conductor strip 42 to determine when and where the purging ink droplets are fired. First, several embodiments dealing with the question as to when to purge are described.

In one embodiment, the printer controller 46 or the host computer 45 may monitor various printhead characteristics to determine when the nozzles require purging. For example, the printhead temperature may be monitored, with a rise in temperature indicating a possible nozzle blockage or occlusion which needs to be cleared by spitting. As another example, the energy efficiency or cogation of the printhead 34, 36 may be monitored over time, with a drop in efficiency indicating a need for nozzle purging. The temperature, energy efficiency or cogation may be measured using a variety of different monitoring devices known to those skilled in the art. For example, the resistor, which is energized to heat the ink at each nozzle for ejection, may be monitored to determine this temperature, and the energy delivered to this resistor may also be measured. It is apparent that the exact thresholds for temperature or efficiency that trigger a need for purging vary with the types of inks used, the pen design, selected print quality (e.g., draft, normal or presentation quality), and other factors known to those skilled in the art.

In another embodiment, the illustrated controller 46 or the host computer 45 may monitor and count the number of times each nozzle is fired for each pass of the carriage 38 over the print zone 25. The timing of each pass of the printhead 34, 36 scanning across the print zone 25 may also be monitored. This monitoring may be done on a predictive basis, by analyzing the image data before the image droplets are fired. This allows image and purging droplets to be laid down during the same pass if desired. Either the controller 46 or the host device 45 may monitor the number of image ink droplets designated for each nozzle to generate the firing control signal sent to printheads 34, 36 via conductor 42.

An image firing rate for printing image 80 is determined based upon the monitored number of firings of each nozzle, and the timing of each pass. The image firing rate is then compared, on a per nozzle basis, to a target firing rate required to maintain pen health. For example, the target firing rate may be set to ensure that each nozzle has been fired a target number "N" times for every "M" seconds. Preferably, for a pigment based ink, the spitting of each nozzle is conducted at a rate of ten drops (N=10) per nozzle every five seconds (M=5) to maintain pen health, whereas dye based inks may require a purging rate often drops (N=10) per nozzle every ten seconds (M=10). When the image firing rate is less than the target rate, the decision is made to fire purging ink droplets at a rate to make up the difference between the target rate and the image firing rate.

As a further embodiment of the present invention, the nozzles may be purged on the page 78 by firing all of the nozzles or groups of nozzles on a regular basis, such as at selected time intervals, without monitoring printhead characteristics. However, identifying only nozzles in need of purging, then spitting only these identified nozzles, is preferred to save ink. It is apparent that the hardware for the individual timers required for each nozzle may require the use of a large area of semiconductor, such as silicon, as well as more processor band width to manage the individual control for firing each nozzle. However, advances in integrated circuit technology continually render the cost of manufacturing such timers to be more economical.

Having now described several embodiments dealing with when to purge, the next question to be determined by the control system 46 and/or computer 45 is where to purge. Indeed, the determination of where to purge each nozzle may be applied to select various on-page spitting routines, or a spittoon-only spitting system, or to a combination on-page/spittoon purging system, each in accordance with the present invention. Several on-page purging routines, where the spitting pattern overlays the image 80, are described below for selecting where to spit on page 78.

"Hide in the Background"

On-Page Spitting System

In accordance with the illustrated embodiment of the present invention, while printing image 80 the black pen 30 performs spitting on the page 78 to hide the purging droplets from view. During recent product improvements, pen servicing requirements have gone from eight drops per nozzle every fifty seconds for the dye based inks used several years ago, to approximately ten drops every five seconds with the current pigment based black ink. While the pigment based inks provide darker more vivid images on the printed page, by their very nature they require more frequent purging. For example, the illustrated printer 20 is expected to spend five to ten percent of the total page print time performing spits in the spittoon 72 to maintain pen health. This represents a significant decrease in the possible throughput of the printer 20 over that achieved with the earlier printers.

It was discovered that small dots, for example, those having a diameter on the order of 0.05 mm (0.002 inches), were very difficult to observe when randomly placed upon a page. It is apparent that the ability to hide such a random scattering of drops over a page improves as the drop size decreases. Thus, as higher resolutions are achieved through developments in printing technology, the methods illustrated for hiding purging droplets on a page will be even more successful in practice.

The throughput of printer 20 may be significantly increased by spraying maintenance drops randomly on the page 78, instead of hindering throughput by moving the printhead over the spittoon 72 for spitting. It is also apparent that for presentation quality printing, it may be preferable to return to a spittoon-only spitting routine. Some spittoon spitting may still be useful for handling large amounts of purged ink from either pen 30 or pen 32, such as after priming at pen initiation, or following a period of printer inactivity.

In one preferred embodiment, the randomly fired health maintenance drops are spit at locations which are preferably at least three dots away from any "real" dots used to form image 80, if such spacing is possible. To hide the purging ink droplets in the background 92, they are preferably spaced at least three dots away from each other if possible. This scheme of randomly placing the health maintenance drops away from image 80 ensures that the purging droplets blend into the background portion of the blank region 92, and do not appear as bumps along the boundaries of the printed text 84, 85, graphics 88, etc., which form image 80.

The effect of hiding purging droplets was tested by spraying a random pattern of dots on a page, and then printing text over the top of the sprayed test sheet. The purged dots were found to be unnoticeable to the naked human eye. However, one preferred implementation preferably monitors a characteristic of each nozzle to minimize the amount of ink used for health maintenance of the pen 30. This hide in the background purging scheme is preferred for printhead resolutions of 600 dots per inch (dpi) or finer resolutions. While illustrated with respect to black ink spitting, it is apparent that this random spit-in-the-background scheme may also be used with the color pen 32.

"Hide in the Black"

On-Page Spitting System

In accordance with the present invention, while printing image 80 the color pen 32 performs spitting on the page 78 in the black areas of image 80, to hide the purging droplets from view. For example, the illustrated tri-color pen 32 uses dye based inks which require spitting in the range of approximately ten drops every ten seconds. Using a conventional spitting system, this servicing rate requires many time consuming trips to the spittoon 74 while printing documents. Rather than continually tracking the printhead 32 to the spittoon 74, it was discovered that small volumes of color ink droplets that are fired in black print areas, such as title 82, text 84, 85 or the border 90 of image 80, are unobservable to the naked eye. This method of hiding the color spitting increases the throughput of printer 20, without effecting the print quality of the hard copy output.

Preferably, the color purging drops from printhead 36 are placed in black printed regions of image 80 which are wide enough to assure that all of the color droplets indeed land within the black area, rather than along the edge of a black area. For example, in printer design, there is usually a known misalignment between the color and black pens, such as up to three dot widths. The color purging droplets are then located at least this misalignment distance, here, three drop widths, from a black border drop to hide the purging droplets from view. This hide in the black purging scheme is useful for any resolution. While illustrated with respect to color spitting, it is apparent that the black nozzles of pen 30 may also be purged using this spit-on-the-black scheme.

This hide-in-the-black spitting routine may be implemented in a variety of different ways. One preferred method purges during a shingling printing routine. The concept of shingling the print swaths is well known in the art, and is used to alleviate several printing difficulties, including the prevention of banding in the finished image and saturation of the print media with wet ink. Typically, shingling entails partially overlapping the print swaths, like shingles on a house, by first printing only a portion of the dots required for a given swath on a first pass of carriage 38 across the print zone 25. Then, rather than advancing the print media 78 a full swath width, only an incremental advance is made, such as a quarter or half step. The next printhead pass lays down additional dots over the first deposited set of dots, as well as laying down a portion of the dots in the next swath. For instance, in a half step or 50% shingling routine, for each pass of the printhead carriage 38, one swath is being completed, and the next swath is being started.

In the illustrated embodiment, the purging droplets may be laid down in the black image areas during any pass of a shingling routine. Preferably, for purging the color pen 32, the purging droplets are fired to be deposited over already printed black dots. It is apparent that shingling may be used to deposit purging droplets in any of the patterns described herein. Indeed, the printing methods described herein are equally applicable to other printing mechanisms, including page width array printing mechanisms. It is also apparent that black and color dots may be hidden in color patterns as well, although not always as well as they can be hidden in black print patterns.

"Hide in Plain View"

On-Page Spitting Systems

It is also possible to hide the purging droplets in plain view on the page 78, in accordance with the present invention. Preferably, the purging dots are placed on the page 78 in an esthetically pleasing pattern. For example, the controller 46 or host computer 45 may make the printed images slightly wider by placing purging dots along the borders of image dots. For instance, when printing text this system of widening the image may have the pleasing effect of appearing as bolder printed characters.

In another embodiment, a speed printing mode is made available, in addition to the conventional selections of draft, normal and presentation print quality modes. This speed printing mode may purge the nozzle in a specific location on the page 78. One pleasing pattern may be two speed bars 94 and 96 located along each edge of the print zone 25. At the end of each print swath, before returning across the page, the nozzles may be purged at the speed bars 94, 96. The speed bars 94, 96 may be single or double lines, or other patterns, such as intertwined lines, diamonds, vines, etc.

In a further embodiment, the nozzles may be purged on the page 78 in a pattern, similar to a watermark on bond paper, placed in a central location. Alternatively, the purging image may be distributed over the entire sheet, such as the background pictures may consumers select for their personal checks. This pleasing pattern may take the form of common objects, such as geometric shapes, like a star or diamond, or wildlife images, like an eagle, deer or bear, or person's initials, a logo or a trademark, such as the "hp" trademark pattern 98, which is owned by the Hewlett-Packard Company, assignee of this patent application.

Alternatively, rather than limiting the pattern to a central location on page 78, a repeating pattern of purging droplets may be located over the entire page. A selection of patterns may be supplied with the printer 20, or the patterns may be defined by the user and input through the host computer, for instance. These patterns, whether centrally located or, more preferably distributed over the entire page, give the impression that a specially printed bond has been used to print the image 80.

This hide in plain view purging scheme may be particularly useful for printhead resolutions on the order of 300 dpi, which are not as easily hidden from view using the hide in background or hide in the black schemes. However, this hide in plain view scheme is also applicable to finer resolutions, including 600 dpi or greater.

Advantages

Thus, using the black and color on-page spitting systems illustrated above, printer throughput is increased in most printing modes, such as normal and draft printing modes. It may still be preferable to limit spitting to the spittoon area 70 for generating presentation quality, that is very high quality, hard copy outputs from printer 20. This increase in throughput rating for normal everyday use is more attractive to some consumers, who base their purchasing decisions upon printer speed. Thus, the faster throughput is accomplished without sacrificing the quality of the printed image 80.

As illustrated by several of the claims appended below, the method steps illustrated above may also be combined to purge an inkjet printhead used in an inkjet printing mechanism. For instance, the steps of firing selected nozzles of the printhead to deposit image ink droplets on a print media page to print a selected image, and of purging selected nozzles by firing to deposit purging ink droplets on the page may be used where the printed image includes at least one black printed area or a color printed area. Here, the purging step may comprise locating the purging ink droplets in at least one of the black or color printed areas of the image. For example, the locating step may comprise locating the purging ink droplets away from edges of any printed area, or the purging step may comprise locating color ink droplets in the black areas of the image.

An advantage of the purging methods illustrated, is that depending upon the implementation, less ink is consumed. Conventional spittoon-only spitting systems typically purge all of the nozzles simultaneously, whether or not the individual nozzles need to be spit. This conventional spitting system wastes ink. If the duty cycle of all the nozzles is tracked, by counting dots fired or monitoring a printhead characteristic, and only the nozzles which have been used less frequently to print image 80 are purged, then total ink consumption for spitting is decreased. This method conserves ink and increases the effective utilization of each cartridge 30, 32. Whether the spitting occurs on the page, in the spittoon only, or in both locations, by only firing the nozzles which need purging, ink is conserved.

Another significant advantage of the on-page spitting systems illustrated herein is that less ink residue is accumulated in the spittoons 72, 74. For instance, while some spittoon spitting may likely still be required, such as after priming the pens 30, 32, overall, less ink accumulates in the spittoon region 70. As a further advantage, the diaper 76 lasts longer before requiring replacement. For example, in the illustrated printer 20 using the on-page spitting system described above, one-third less ink is accumulated in the spittoons 72, 74 than when using a spittoon-only spitting routine.

We claim:

1. A method of purging an inkjet printhead used in an inkjet printing mechanism, comprising the steps of:

firing selected nozzles of the printhead to deposit image ink droplets on a print media page to print a selected image;

purging selected nozzles by firing to deposit purging ink droplets on the page; and blending the purging ink droplets into a background portion of the page.

2. A method according to claim 1, further comprising the step of locating the purging ink droplets on the page in a blank space without image ink droplets.

3. A method according to claim 2, further comprising the steps of:

analyzing the firing required of each nozzle to print the image;

selecting the nozzles in need of purging; and conducting the firing and purging steps concurrently.

4. A method according to claim 1, wherein the purging step comprises locating purging ink droplets in a pattern along two opposing edges of the page.

5. A method according to claim 1, wherein the blending step comprises randomly distributing the purging droplets in the background portion of the page.

6. A method according to claim 1, wherein:

each droplet has a dot width when deposited on the page; and the blending step comprises the step of locating each purging ink droplet at least three dot widths away from other purging ink droplets.

7. A method according to claim 1, wherein:

the method further includes the step of counting the number of image ink droplets fired from each nozzle; and the purging step responds to the counting step by firing purging droplets from nozzles in need of purging.

8. A method according to claim 1, further comprising the steps of:

monitoring the number of image ink droplets fired by each nozzle;

comparing the monitored number of image droplets fired with a selected standard number; and in response to the comparing step, firing a number of purging ink droplets from each nozzle so the sum of the numbers of purging and image ink droplets for each nozzle substantially exceeds the selected standard number.

9. A method according to claim 8, wherein the comparing step is repeated at selected time intervals during printing.

10. A method according to claim 1, wherein the purging step comprises selecting all the nozzles for purging.

11. A method according to claim 1, further comprising the step of firing a number of purging ink droplets from each nozzle to ensure that each nozzle has been fired a selected number of times during printing for consecutive time intervals of selected duration.

12. A method according to claim 1, further including the steps of:

monitoring a characteristic of each nozzle; and determining from the monitored characteristic which nozzles to select for firing in the purging step.

13. A method according to claim 12, wherein:

the monitoring step comprises the step of monitoring the temperature of each nozzle; and the determining step comprises the step of comparing the monitored temperature of each nozzle with a threshold limit to select any nozzle for the purging step that has a temperature failing the threshold.

14. A method according to claim 12, wherein:

the monitoring step comprises the step of monitoring the efficiency of each nozzle; and the determining step comprises the step of comparing the monitored efficiency of each nozzle with a threshold limit to select any nozzle having an efficiency failing the threshold for the purging step.

15. A method according to claim 1, wherein:

the printed image includes at least one black printed area or a color printed area; and the purging step comprises locating the purging ink droplets in at least one of the black or color printed areas of the image.

16. A method according to claim 15, wherein the locating step comprises locating the purging ink droplets away from edges of any printed area.

17. A method according to claim 15, wherein the purging step comprises locating color ink droplets in the black areas of the image.

18. A method according to claim 1, wherein:

the printing mechanism includes a spittoon portion; and the method further includes the step of spitting by firing selected nozzles to deposit ink droplets into the spittoon.

19. A method according to claim 1, wherein the purging step comprises locating purging ink droplets beside image ink droplets.

20. A method according to claim 1, wherein the purging step comprises locating purging ink droplets in a pattern on the page.

21. A method according to claim 1, wherein the purging step comprises locating purging ink droplets in a pattern that is repeated on the page.

22. A method of purging an inkjet printhead used in an inkjet printing mechanism, comprising the steps of:

firing selected nozzles of the printhead to deposit image ink droplets on a print media page to print a selected image;

purging selected nozzles by firing to deposit purging ink droplets on the page;

in consecutive passes, scanning the printhead through a print zone of the inkjet printing mechanism during the firing and purging steps;

tracking the number of times each nozzle is fired during each pass;

monitoring the timing of each pass; and determining from the tracking and monitoring steps of one pass which nozzles to fire in the purging step during the next pass following said one pass.

23. A method of purging an inkjet printhead used in an inkjet printing mechanism including a spittoon portion, comprising the steps of:

firing selected nozzles of the printhead to deposit image ink droplets on a print media page to print a selected image;

providing a selection of at least two different modes of print quality;

identifying nozzles in need of purging; and purging the identified nozzles by firing to deposit purging ink droplets, and depositing the purging ink droplets on the page for a first print quality mode, and depositing the purging ink droplets in the spittoon for a second print quality mode.

24. A method according to claim 23, wherein:

the inkjet printing mechanism comprises an inkjet printhead that makes multiple passes across a print zone to print the image in a multipass shingled print mode; and while printing in the first print quality mode, the purging step further comprises the step of depositing the purging ink droplets under or on top of image ink droplets in a multipass shingled print mode.

25. A method according to claim 23, wherein the purging step comprises depositing the purging ink droplets on the page by blending the purging ink droplets into a background portion of the page.

26. A method according to claim 23, wherein the identifying step comprises the step of counting the number of image ink droplets fired from each nozzle.

27. A method according to claim 23, wherein the identifying step comprises the steps of:

monitoring a characteristic of each nozzle; and determining from the monitored characteristic whether the nozzle is in need of purging.

28. A method according to claim 27, wherein:

the monitoring step comprises the step monitoring the temperature of each nozzle; and the determining step comprises comparing the monitored temperature of each nozzle with a threshold limit to identify any nozzle having a temperature failing the limit as being in need of purging.

29. A method according to claim 27, wherein:

the monitoring step comprises the step monitoring the efficiency of each nozzle; and the determining step comprises comparing the monitored efficiency of each nozzle with a threshold limit to identify any nozzle having an efficiency failing the limit as being in need of purging.

30. An inkjet printing mechanism, comprising:

a chassis;

a printhead mounted to the chassis for movement across a print zone, the printhead having plural nozzles selectively fired to deposit image ink droplets on a print media page to print a selected image in response to a control signal;

a spittoon portion; and a controller that generates the control signal to fire purging ink droplets from selected nozzles to deposit purging ink droplets on the page for a first print quality mode, and to deposit the purging ink droplets in the spittoon for a second print quality mode.

31. An inkjet printing mechanism according to claim 30, wherein the controller generates the control signal in response to a signal received from a host device.

32. An inkjet printing mechanism according to claim 31, wherein the controller or the host device monitors the number of image ink droplets designated for each nozzle to generate the control signal.

33. An inkjet printing mechanism according to claim 30, wherein:

the mechanism further includes for each nozzle, a monitor device that monitors a nozzle characteristic; and either the controller or the host device responds to the monitored characteristic of each nozzle to adjust the control signal.

34. An inkjet printing mechanism according to claim 33, wherein:

the monitor device monitors the temperature of each nozzle; and the control signal is adjusted to, select nozzles from which purging ink droplets are fired when the monitored temperature fails a threshold limit.

35. An inkjet printing mechanism according to claim 33, wherein:

the monitor device monitors the efficiency of each nozzle; and the control signal is adjusted to select nozzles from which purging ink droplets are fired when the monitored efficiency fails a threshold limit.

36. An inkjet printing mechanism according to claim 30, wherein:

the inkjet printhead is mounted to the chassis for movement in multiple passes across the print zone to print the image in a multipass shingled print mode; and while printing in the first print quality mode, the controller generates the control signal to deposit purging ink droplets on the page either under or on top of image ink droplets in the multipass shingled print mode.

37. An inkjet printing mechanism according to claim 30 wherein, while printing in the first print quality mode, the controller generates the control signal to deposit the purging ink droplets on the page by blending the purging ink droplets into a background portion of the page.

* * * * *